US005524314A

United States Patent [19]

Dickinson et al.

[11] Patent Number: 5,524,314

[45] Date of Patent: Jun. 11, 1996

[54] MOP HOLDER WITH SCRAPER

[75] Inventors: Thomas Dickinson; Bradley D. Gale, both of St. Louis, Mo.

[73] Assignee: Contico International, Inc., St. Louis, Mo.

[21] Appl. No.: 420,227

[22] Filed: Apr. 11, 1995

[51] Int. Cl.[6] ..... A47L 13/12

[52] U.S. Cl. ..... 15/105; 15/153; 15/236.08

[58] Field of Search ..... 15/105, 147.1, 15/147.2, 148–154, 154.2, 236.01, 236.05–236.09

[56] References Cited

U.S. PATENT DOCUMENTS

| | | | |
|---|---|---|---|
| D. 355,075 | 2/1995 | Stone | D4/118 |
| 478,657 | 7/1892 | Tarring | 15/105 |
| 618,663 | 1/1899 | Hale | 15/105 |
| 729,338 | 5/1903 | Hawkins | 15/148 |
| 1,020,866 | 3/1912 | Willis | 15/105 |
| 1,209,929 | 12/1916 | Bailey | 15/151 |
| 1,282,780 | 10/1918 | Dunagan | 15/105 |
| 2,070,420 | 2/1937 | Burns | 15/105 |
| 2,290,178 | 7/1942 | Hayford | 15/236.01 |
| 2,845,643 | 8/1958 | Provencal et al. | 15/105 |
| 3,103,028 | 9/1963 | Richards | 15/236.01 |
| 3,452,383 | 7/1969 | Eichner | 15/147.2 |
| 4,059,864 | 11/1977 | Spresny | 15/105 |
| 4,422,203 | 12/1983 | Zenker | 15/150 |
| 4,483,035 | 11/1984 | Moss et al. | 15/153 |
| 4,694,524 | 9/1987 | Kim | 15/105 |

FOREIGN PATENT DOCUMENTS

| | | | |
|---|---|---|---|
| 3935747 | 4/1991 | Germany | 15/105 |

*Primary Examiner*—Mark Spisich

*Attorney, Agent, or Firm*—Howell & Haferkamp

[57] ABSTRACT

A mop holder having a frame and a scraper component attached to the frame for removing stubborn materials from floors or baseboards, where the scraper has tapered sides terminating at a scraping edge and is provided with a plurality of teeth.

20 Claims, 2 Drawing Sheets

MOP HOLDER WITH SCRAPER

BACKGROUND OF THE INVENTION (1) Field of the Invention

The present invention pertains to a mop holder for holding a mop for janitorial applications, and more particularly, to a mop holder having a scraper provided thereon.

(2) Description of the Related Art

Mop holders of a variety of types are well known in the art of janitorial equipment, including mop holders for supporting string-like mop swabs and mop holders for supporting sponge mops. These mop holders are generally constructed from metals, plastics, or some combination thereof, and range from having only a few to many component parts.

Most of the mop holders in use today are designed to reduce or eliminate the need for a user to handle the mop supported thereby. In the case of sponge mops, most of these mop holders provide handles or levers for hands-free wringing of the mop, while in the case of mop holders for mop swabs, provisions are made for changing the mop swab without having to handle the swab, particularly when removing the mop swab from the mop holder. The mop holder for holding mop swabs is typically provided with a pivoting loading bar, or a pivoting side support, or both, so that upon pivoting or disconnecting the loading bar or side support, the mop swab is free to slide out from the mop holder without the need for handling by the user. Despite these moving parts, almost all of the mop holders of the prior art are configured so that none of the component parts protrude outwardly from the frame, thereby avoiding the risk of unintentionally marking the floor being mopped. An example of such a mop holder is shown in Moss et al., U.S. Pat. No. 4,483,035.

However, in using these mop holders of the prior art, materials are often encountered which are stuck to the surface being mopped, and which cannot be removed by mopping alone. For this reason, it is common for users of the mop holders of the prior art, including janitors and others, to carry a putty knife or other type of scraping device for scraping stubborn materials from a floor or baseboard being mopped. Where these materials are encountered and a scraping device is not readily available, significant time can be lost procuring such a device, or the quality of the mopping operation might be sacrificed. Moreover, where putty knifes or similar scraping devices are utilized for removing stubborn materials, the janitor must bend over or kneel down to perform the scraping operation, and may be injured as a result, especially when these operations are performed repeatedly over a period of time.

SUMMARY OF THE INVENTION

The mop holder of the present invention overcomes the shortcomings of prior art mop holders discussed above by providing a scraper that is connected to the frame of the mop holder. In the preferred embodiment, the scraper is integrally molded with the frame of the mop holder, and both are formed of plastic. The key aspect of the present invention resides in its simplicity. While providing a scraper on the frame of a mop holder almost negligibly increases the cost of the mop holder, it greatly increases the usefulness of the mop holder and eliminates the need for procuring a scraping device during a mopping operation when materials are encountered that are stuck to the surface being mopped. Since removal of such materials might otherwise be foregone in the absence of a readily available scraping device, the scraper of the present invention might also result in a more thorough cleaning operation. Moreover, by eliminating the need for bending or kneeling by the user of the mop holder, costly injuries, including back or neck injuries, might also be avoided.

In the preferred embodiment, the scraper of the present invention is provided on a mop holder of the type for holding mop swabs. The mop holder includes a forked frame, a loading bar, a side gate, and a sliding clamp. The side gate is pivotally connected to the forked frame, and can be pivoted to an open position to remove and replace a mop which is supported by the loading bar. When pivoted to a closed position, a rib within an opening in the side gate releasably engages a hook on a free end of the loading bar. This engagement between the side gate and loading bar prevents a mop supported by the loading bar from sliding out of the mop holder during use. The sliding clamp includes a threaded shaft that is in threaded engagement with a thumb wheel provided within the forked frame. By turning the thumb wheel, the sliding clamp moves towards the loading bar. Tabs protruding from sides of the sliding clamp engage guideways provided on the forked frame for guiding the movement of the sliding clamp towards and away from the loading bar upon rotation of the thumb wheel. The sliding clamp holds a mop against the loading bar, with the force exerted by the sliding clamp on the mop, and consequently on the loading bar, retaining the hook on the free end of the loading bar in engagement with the rib in the opening of the side gate, thereby preventing the mop from sliding out of the mop holder during use.

The scraper of the present invention projects outwardly from a curved corner of the forked frame. Hence, the scraper projects outwardly from a bottom end of the mop holder as well as from a side of the mop holder. For this reason, the scraper can be easily used to remove stubborn materials from a floor surface, or from a vertical surface, such as a baseboard. Moreover, positioning the scraper on a corner of the forked frame facilitates pivoting the mop holder at an angle so that only the scraper portion of the mop holder is contacting a floor or wall, and so that all of the weight of the user can be concentrated on the edge of the scraper. Providing the scraper on the curved corner of the forked frame also helps to avoid interference between the mop supported by the mop holder and use of the scraper.

The forked frame and scraper of the preferred embodiment both lie in a plane, and the sides of the scraper are oriented at an angle relative to the plane of the frame to give the scraper a wedge-like configuration, with the two sides tapering together towards a scraping edge. The scraper is also provided with a plurality of teeth along the scraping edge for cutting into stubborn materials adhered to a surface being mopped.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENTS

Figure 1:
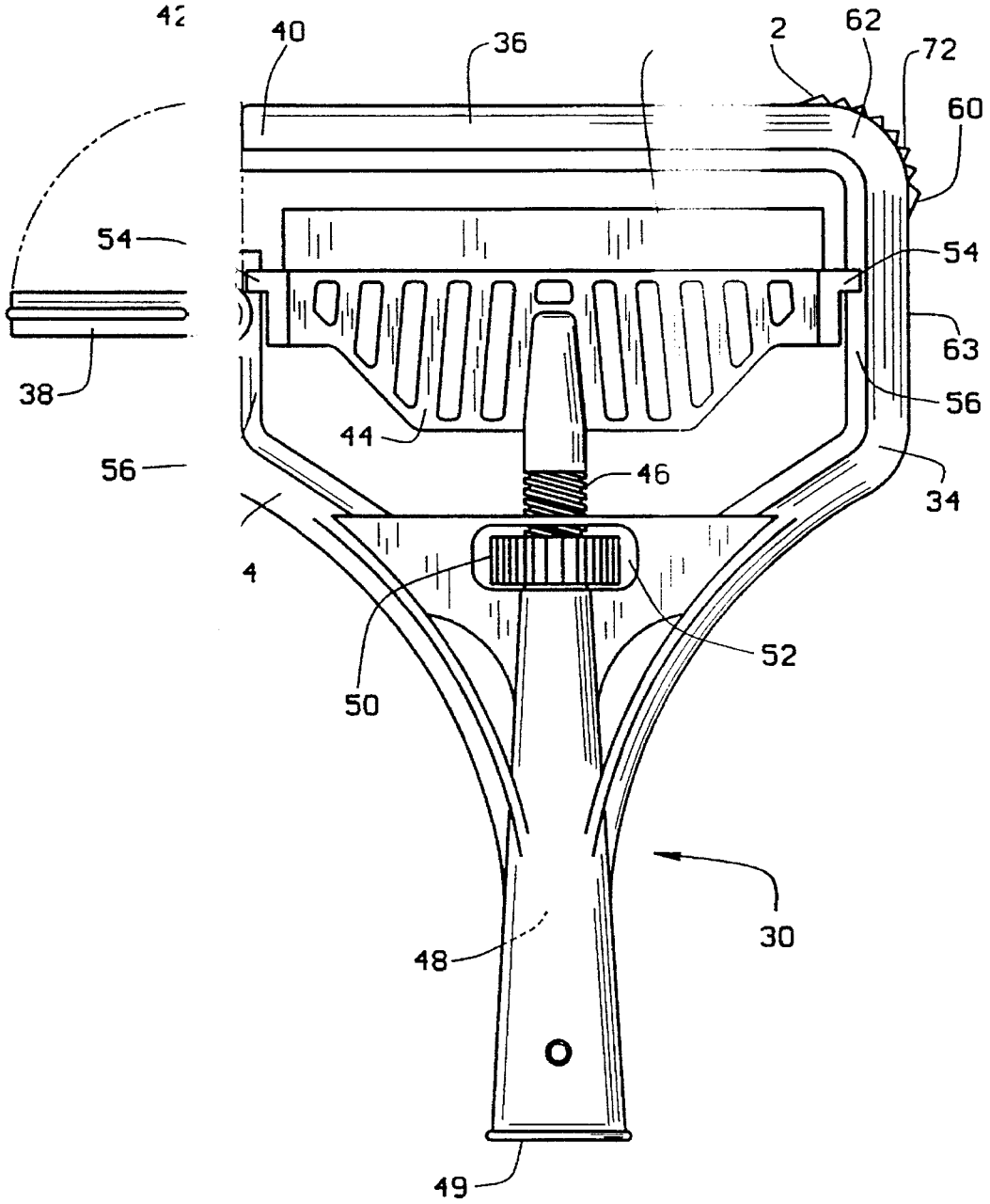
FIG. 1 is a front elevation view of the mop holder of the present invention illustrating the side gate in the open position.
Figure 2:
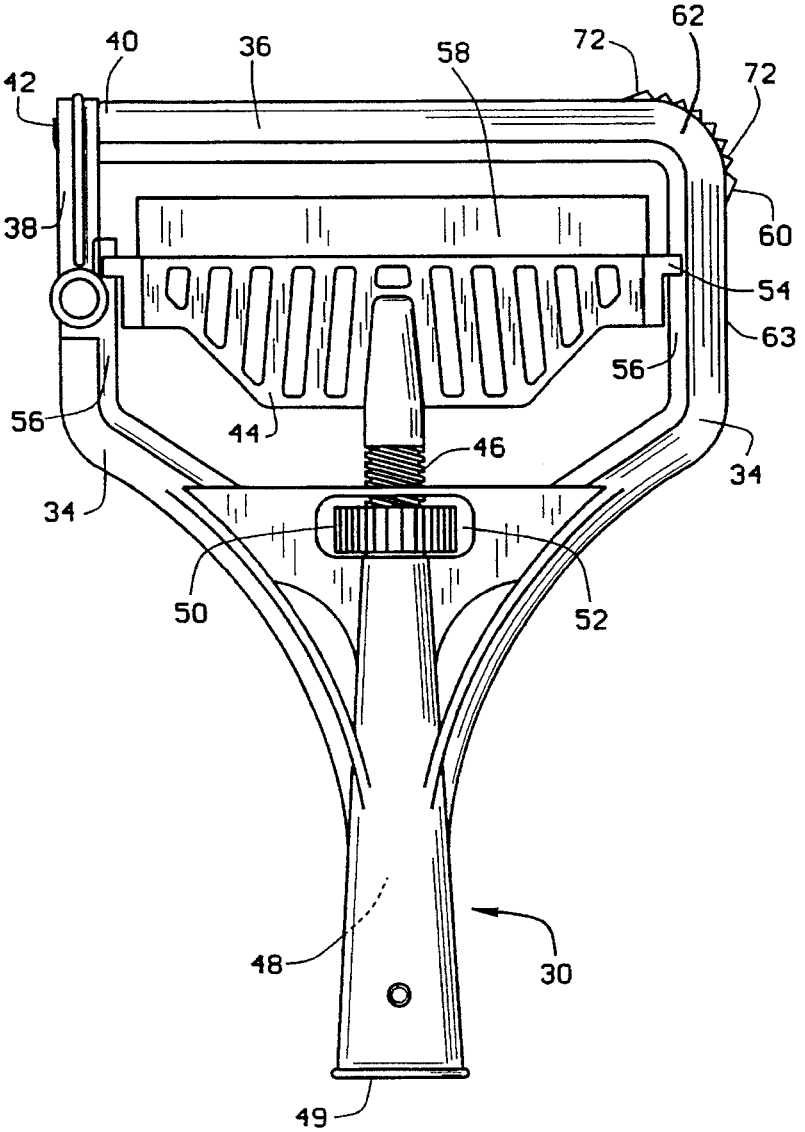
FIG. 2 is a front elevation view of the mop holder of FIG. 1 illustrating the side gate in the closed position.

Aside from the novel scraper provided on the mop holder of the present invention, mop holders of the general type shown in the figures are well known in the art, and for this reason, only a general description of the known component parts and their operation will be provided. The mop holder 30 of the preferred embodiment includes a yoke or forked frame 34, a loading bar 36 for supporting a mop, and a side gate 38 for facilitating the removal and insertion of a mop from and into the mop holder. One end of the loading bar 36 is integrally formed with the forked frame 34, and the opposite end, or free end 40 is configured for releasably engaging the side gate 38. The side gate 38 is pivotally connected to the forked frame 34 and, upon disengagement from the loading bar 36, can be pivoted to an open position as shown in FIG. 1.

With the side gate 38 in the open position, a mop (not shown) can be easily removed from or inserted into the mop holder 30 to be supported by the loading bar 36. Upon insertion of the mop, the side gate 38 can be pivoted until it releasably engages the free end 40 of the loading bar 36. The side gate 38 has a slot or opening (not shown) through which the free end 40 of the loading bar 36 is inserted, and the free end 40 of the loading bar is provided with a hook 42 for engaging a rib (not shown) provided within the slot of the side gate. This engagement between the rib of the side gate 38 and the hook 42 on the free end of the loading bar 36 prevents the side gate from opening during use of the mop holder with a mop.

The mop holder 30 also includes a sliding clamp 44 for clamping a mop to the loading bar 36. A threaded shaft 46 is integrally formed with the sliding clamp 44, and is inserted into a socket 48 in the forked frame 34. An opposite end 49 of the socket 48 is configured to receive a handle (not shown) to be used in conjunction with the mop holder, although the handle can alternatively be integrally formed with the forked frame 34 of the mop holder 30. The threaded shaft 46 is provided in threaded engagement with a thumb wheel 50 that is positioned within an opening 52 in the forked frame. Rotation of the thumb wheel 50 in a first direction will cause the sliding clamp 44 to move towards the loading bar 36, while rotating the thumb wheel in an opposite direction will cause the sliding clamp 44 to move away from the loading bar 36. This movement of the sliding clamp 44 is directed by tabs 54 that protrude from sides of the sliding clamp, and that slidably engage guideways 56 provided on the forked frame 34.

Upon insertion of a mop into the mop holder 30, and after pivoting the side gate 38 into releasable engagement with the hook 42 on the free end 40 of the loading bar, the thumb wheel 50 can be turned in the first direction to cause the sliding clamp 44 to move towards the loading bar 36. As the sliding clamp moves towards the loading bar, clamping plates 58, which are integrally formed with the sliding clamp 44, will engage the mop and force the mop against the loading bar 36. The force provided to the loading bar by the sliding clamp 44 will result in a positive latch between the rib in the slot of the side gate 38 and the hook 42 on the free end 40 of the loading bar, thereby preventing the side gate from inadvertently pivoting to the open position when the mop holder 30 is in use.

The novel aspect of the present invention resides in the scraper 60 that is connected to the forked frame 34. The scraper 60 is provided for removing stubborn items or materials from a floor or wall which cannot be removed solely by a mop. By simply providing the scraper 60 on the forked frame 34, the utility of the mop holder 30 is substantially increased, and the need for a person using the mop holder to carry a separate scraper or putty knife is significantly reduced or eliminated, which, in turn, significantly reduces or eliminates the need for that person to bend over in order to remove stubborn items with a hand tool. Hence, the scraper 60 satisfies a long-felt but unsolved need in the art of mop holders.

In the preferred embodiment, the scraper 60 is positioned on the forked frame so that use of the scraper is not obstructed by a mop that is supported by the loading bar 36. Thus, the scraper must be spaced, at least to a limited extent, from the portion of the loading bar 36 that supports a mop. As shown in the figures, the mop holder 30 of the preferred embodiment has the scraper 60 positioned on a curved corner 62 of the forked frame adjacent to the portion of the loading bar 36 that supports a mop. This position of the scraper is advantageous for several reasons. Since the scraper of the preferred embodiment projects outwardly from an outer surface of the curved corner, during ordinary use of the mop holder 30, one portion of the scraper projects outwardly towards the floor being mopped while another portion of the scraper extends outwardly from a side surface 63 of the forked frame. As a result, the scraper can be used to remove materials from the floor as well as from a vertical surface, such as a baseboard, without substantially altering the orientation of the mop holder 30 during a normal mopping operation. However, for removing more stubborn materials from a floor or vertical surface, the mop holder 30 can be oriented in a diagonal fashion such that only the scraper portion 60 of the mop holder is contacting the surface to be scraped, thereby allowing a user of the mop holder to maximize the amount of force exerted on the scraper portion 60.

Figure 3:
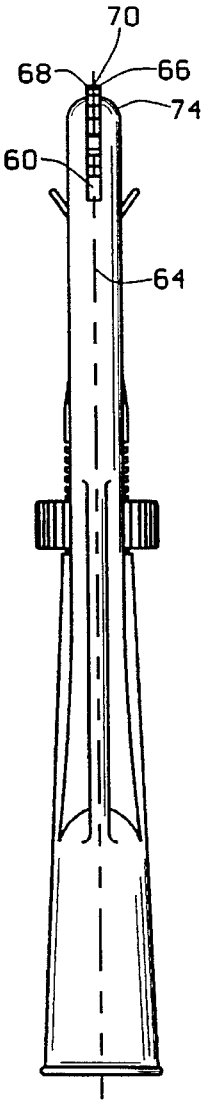
FIG. 3 is a side profile view of the mop holder of FIGS. 1 and 2, illustrating the tapered configuration of the scraper of the preferred embodiment.
Figure 1:
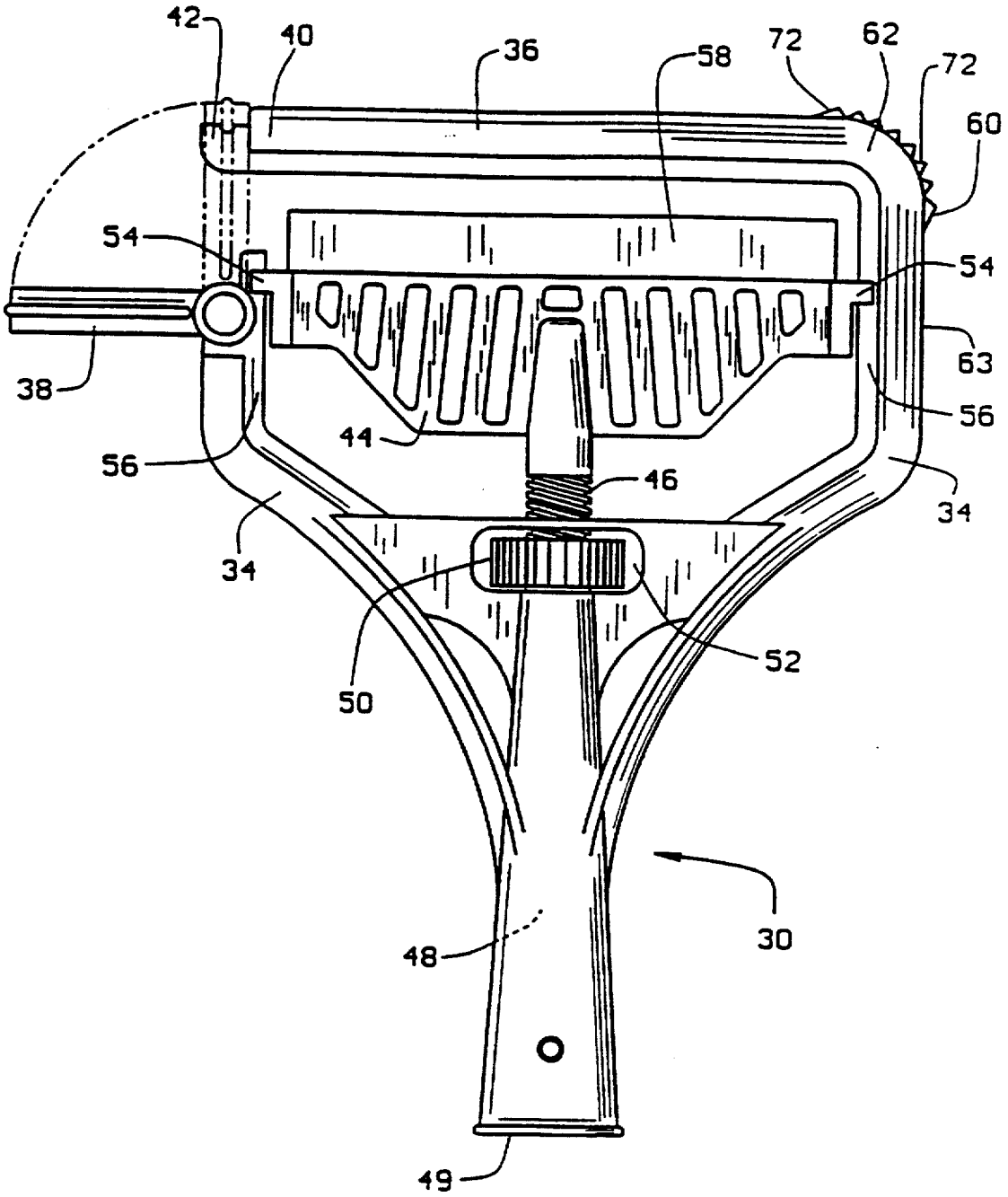

As shown in FIG. 3, the forked frame 34 lies within a plane 64, as does the scraper 60 of the preferred embodiment. The scraper has two sides 66 and 68, both of which are oriented at an angle relative to the plane 64. In other words, the sides 66 and 68 of the scraper 60 are tapered towards a scraper edge 70, giving the scraper a wedge-like configuration. This allows the scraper edge 70 to remain relatively close to the surface being scraped and to contact stubborn items to be removed at a point where these items are attached to or contact the surface. Although both sides 66 and 68 of the scraper 60 are oriented at an angle relative to the plane 64 of the forked frame, similar benefits of a tapered scraper can be realized with a scraper having only one side oriented in this manner. Additionally, while the scraper 60 has been described and shown as centered along the plane 64, other positions of the scraper can be utilized with similar effect. For example, side 66 of the scraper could be coextensive with a backside 74 of the forked frame 34, with one or both sides 66 and 68 being oriented at an angle relative to the plane 64.

As shown in the figures, the scraper 60 is also provided with a plurality of teeth 72 which allows the scraper to cut into stubborn items which are to be removed from a surface being mopped. While the teeth 72 are shown as projecting outwardly from an outer surface of the curved corner 62, the scraper 60 could function in a similar fashion to that described above with the teeth provided on the curved corner 62 without projecting outwardly from the outer surface thereof. The scraper can also be provided with a plurality of teeth but without having the sides 66 and 68 oriented at an angle relative to the plane 64.

Additionally, the scraper 60 can be positioned on the curved corner 62 of the frame with the scraper being tapered as described above, but without having teeth 72, and without projecting outwardly from the outer surface of the curved corner. Moreover, a toothed or tapered scraper, or a scraper having both of these features, can be positioned on the forked frame 34 other than at the curved corner 62, such as along a side portion. While the mop holder 30 of the preferred embodiment has been described and shown as having only one scraper 60, additional scrapers can also be provided.

The scraper 60 of the preferred embodiment is integrally formed with the forked frame 34, preferably from plastic. In fact, preferably all of the component parts of the mop holder 30 are formed from plastic, resulting in a lightweight mop holder that is generally immune to corrosion problems. Integrally forming the scraper 60 with the forked frame 34 provides for an economy of parts, as well as for an economy of mass production. Alternatively, the scraper can be provided separately and connected to a mop holder, and can be metallic, as can the mop holder components. Such a scraper might also be a sharpened blade, and for extremely rigorous applications, comprise hard metal tips or wear resistant coatings.

Although the mop holder of the preferred embodiment is of the type used in combination with mops for commercial applications or mop swabs, the scraper feature disclosed herein is equally suitable for use in conjunction with sponge mops, and can also be used with other types of cleaning apparatuses, including squeegees for cleaning windows and similar surfaces.

While the present invention has been described by reference to specific embodiments, it should be understood that modifications and variations of the invention may be constructed without departing from the scope of the invention defined in the following claims.

What is claimed is:

1. A mop holder, comprising:

a frame having a curved corner and means for supporting a mop; and at least one scraper formed on and fixed with respect to the frame and extending along a portion of the curved corner, the at least one scraper having a plurality of teeth.

2. The mop holder of claim 1, wherein:

the at least one scraper is integrally formed with the frame from plastic.

3. The mop holder of claim 1, wherein:

the frame has a side surface, and the at least one scraper projects outwardly from the side surface.

4. The mop holder of claim 1, wherein:

the at least one scraper is positioned on the frame adjacent to the means for supporting a mop.

5. The mop holder of claim 1, wherein:

the at least one scraper projects outwardly from the curved corner.

6. A mop holder of the type having a forked frame, a loading bar connected to the frame for supporting a mop, and a sliding clamp guided by the frame for clamping a mop to the loading bar, the frame, loading bar, and sliding clamp lying in a center plane, the improvement comprising:

at least one scraper connected to the frame and lying in the center plane of the frame, loading bar, and sliding clamp.

7. The improved mop holder of claim 6, wherein:

the at least one scraper has two sides, and at least one of the two sides is oriented at an angle relative to the center plane of the frame, loading bar, and sliding clamp.

8. The improved mop holder of claim 6, wherein:

the frame has a surface, and the at least one scraper projects outwardly from the surface.

9. The improved mop holder of claim 6, wherein:

the at least one scraper has a plurality of teeth.

10. The improved mop holder of claim 6, wherein:

the at least one scraper is positioned on the frame adjacent to the loading bar.

11. The improved mop holder of claim 10, wherein:

the frame merges into the loading bar along a curved corner, and the at least one scraper extends along a portion of the frame, through the curved corner, and along a portion of the loading bar.

12. The improved mop holder of claim 6, wherein:

the frame has a corner, and the at least one scraper extends along a portion of the corner.

13. The improved mop holder of claim 6, wherein:

the at least one scraper is integrally formed with the frame from plastic.

14. A mop holder, comprising:

a looped frame lying in a plane, the looped frame extending around an opening within the frame, the opening being sufficiently large to enable insertion of a mop head through the opening for mounting the mop head on the frame, the looped frame having a clamp mounted on the frame for movement of the clamp to a position adjacent the frame where the clamp secures a mop head inserted through the frame opening to the frame; and at least one scraper formed on and fixed with respect to the looped frame and lying in a plane parallel to the plane of the looped frame.

15. The mop holder of claim 14, wherein:

the at least one scraper is integrally formed with the looped frame.

16. The mop holder of claim 14, wherein:

the looped frame has a surface, and the at least one scraper projects outwardly from the surface.

17. The mop holder of claim 14, wherein:

the at least one scraper has a plurality of teeth.

18. The mop holder of claim 14, wherein:

the clamp extends across the opening of the looped frame.

19. The mop holder of claim 14, wherein:

the looped frame has a corner, and the at least one scraper is positioned at the corner.

20. The mop holder of claim 19, wherein:

the at least one scraper has a plurality of teeth.

* * * * *

UNITED STATES PATENT AND TRADEMARK OFFICE

CERTIFICATE OF CORRECTION

PATENT NO. : 5,524,314

DATED : June 11, 1996

INVENTOR(S) : Thomas Dickinson, et al

It is certified that error appears in the above-identified patent and that said Letters Patent is hereby corrected as shown below:

The title page, showing the illustrative figure, should be deleted and substitute therefor the attached title page.

The drawing sheet, consisting of Fig 1, should be deleted to be replaced with Fig. 1, as shown on the attached page.

Signed and Sealed this

Fifteenth Day of April, 1997

*Attest:*

*Attesting Officer*

BRUCE LEHMAN

*Commissioner of Patents and Trademarks*

United States Patent [19]

Dickinson et al.

[11] Patent Number: 5,524,314

[45] Date of Patent: Jun. 11, 1996

[54] MOP HOLDER WITH SCRAPER

[75] Inventors: Thomas Dickinson; Bradley D. Gale, both of St. Louis, Mo.

[73] Assignee: Contico International, Inc., St. Louis, Mo.

[21] Appl. No.: 420,227

[22] Filed: Apr. 11, 1995

[51] Int. Cl.° ..... A47L 13/12

[52] U.S. Cl. ..... 15/105; 15/153; 15/236.08

[58] Field of Search ..... 15/105, 147.1, 15/147.2, 148–154, 154.2, 236.01, 236.05–236.09

[56] References Cited

U.S. PATENT DOCUMENTS

| | | | |
|---|---|---|---|
| D. 355,075 | 2/1995 | Stone | D4/118 |
| 478,657 | 7/1892 | Tarring | 15/105 |
| 618,663 | 1/1899 | Hale | 15/105 |
| 729,338 | 5/1903 | Hawkins | 15/148 |
| 1,020,866 | 3/1912 | Willis | 15/105 |
| 1,209,929 | 12/1916 | Bailey | 15/151 |
| 1,282,780 | 10/1918 | Dunagan | 15/105 |
| 2,070,420 | 2/1937 | Burns | 15/105 |
| 2,290,178 | 7/1942 | Hayford | 15/236.01 |
| 2,845,643 | 8/1958 | Provencal et al. | 15/105 |
| 3,103,028 | 9/1963 | Richards | 15/236.01 |
| 3,452,383 | 7/1969 | Eichner | 15/147.2 |
| 4,059,864 | 11/1977 | Spresny | 15/105 |
| 4,422,203 | 12/1983 | Zenker | 15/150 |
| 4,483,035 | 11/1984 | Moss et al. | 15/153 |
| 4,694,524 | 9/1987 | Kim | 15/105 |

FOREIGN PATENT DOCUMENTS

| | | | |
|---|---|---|---|
| 3935747 | 4/1991 | Germany | 15/105 |

*Primary Examiner*—Mark Spisich

*Attorney, Agent, or Firm*—Howell & Haferkamp

[57] ABSTRACT

A mop holder having a frame and a scraper component attached to the frame for removing stubborn materials from floors or baseboards, where the scraper has tapered sides terminating at a scraping edge and is provided with a plurality of teeth.

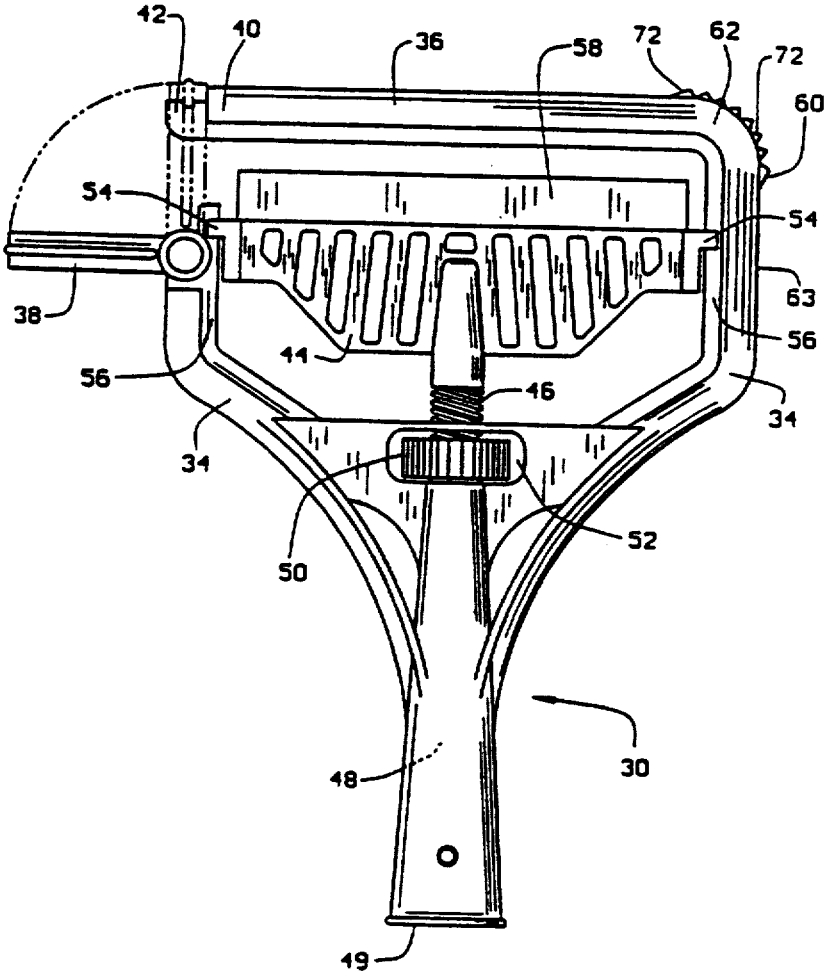

20 Claims, 2 Drawing Sheets